United States Patent [19]

Redd, Jr.

[11] 4,218,217

[45] Aug. 19, 1980

[54] METHOD OF PRODUCING MULTICOLOR DYEINGS

[75] Inventor: Lewis M. Redd, Jr., Douglasville, Ga.

[73] Assignee: Sandoz, Inc., E. Hanover, N.J.

[21] Appl. No.: 665,798

[22] Filed: Mar. 11, 1976

Related U.S. Application Data

[63] Continuation-in-part of Ser. No. 456,678, Apr. 1, 1974, abandoned.

[51] Int. Cl.[2] ..... D06P 5/12

[52] U.S. Cl. ..... 8/478; 8/480; 8/481; 8/448; 8/461; 8/531

[58] Field of Search ..... 8/1 XB, 65, 66, 69, 8/15, 17, 14, 25, 178 R

[56] References Cited

U.S. PATENT DOCUMENTS

| | | | |
|---|---|---|---|
| 2,931,697 | 4/1960 | Wirth et al. | 8/21 |
| 3,322,488 | 5/1967 | Feeman | 8/115.5 |
| 3,743,477 | 7/1973 | Egli et al. | 8/66 |
| 3,775,045 | 11/1973 | Buehler et al. | 8/15 |
| 3,999,940 | 12/1976 | Freeman | 8/14 |

*Primary Examiner*—John Kight, III

*Attorney, Agent, or Firm*—Gerald D. Sharkin; Richard E. Vila; Thomas C. Doyle

[57] ABSTRACT

Multicolored substrates, particularly nylon carpeting, are produced by applying combinations of a colorless reserving agent and an acid, direct or basic dye or mixture of dyes and fixing the reserving agent and the dye(s) simultaneously.

54 Claims, No Drawings

METHOD OF PRODUCING MULTICOLOR DYEINGS

This application is a continuation-in-part of copending application, Ser. No. 456,678, filed Apr. 1, 1974, now abandoned.

This invention relates to a process for the multi-color dyeing of substrates which are dyeable with anionic dyes.

It is known from U.S. Pat. No. 3,743,477, the disclosure of which is incorporated herein by reference, that sustrates of natural polyamide fibers and synthetic fibers dyeable with anionic dyes can be given a multi-color effect by first impregnating selected areas of the substrate with a reserving agent, fixing the reserving agent on the substrate and then applying one or more anionic dyes which react to a much greater degree with those portions of the substrate which have not been treated with the reserving agent, thus producing a pattern of dyed and either undyed or more lightly dyed areas. A greater variety of coloration can be achieved by applying one or more basic dyes either along with or subsequent to the anionic dye, the basic dye being fixed to the reserved areas by virtue of the optional presence of an acid group in the reserving agent.

The present invention provides an improved method of obtaining multi-color effects which offers great flexiblity with respect to the variety of color effects and contrasts that can be achieved and which is more adaptable to continuous operation than are prior art methods.

The present invention resides in part in the discovery that certain reserving agents and dyes can be brought together on a substrate and thereafter fixed in a single and common fixing operation whereby the need for separate fixing steps is eliminated and whereby, if desired, a variety of multicolor effects are readily obtainable. Hence, in its broader aspects, the invention involves applying a basic and/or anionic dye and the reserving agent to a common area of the substrate and then fixng the dye and reserving agent in a single fixing operation.

The substrate to be treated in accordance with the present invention is one that is dyeable with an anionic dye. This includes filaments, fibers, yarns, woven, knitted and other non-woven fabrics of natural polyamide, e.g., wool and silk; synthetic polyamide, e.g. nylon 6, 7, 11, 66, 76, 226, 610, and 6/66; basic modified polypropylene; and basic modified polyacrylonitrile and acrylonitrile copolymers, including blends of such materials having differential dyeability. Preferably, the substrate comprises a polyamide, most preferably a synthetic polyamide, e.g., nylon 6 or nylon 66.

The reserving agent employed is a colorless organic compound containing a group which is highly reactive with the available basic groups of the substrate and also an —$SO_3H$ or —COOH group (or alkali metal salt thereof). Preferably, the compound is not appreciably volatile at 100° C. Suitable compounds of this type include heterocyclic compounds having 1 or 2 exchangeable halogen atoms, for example those of the formulae

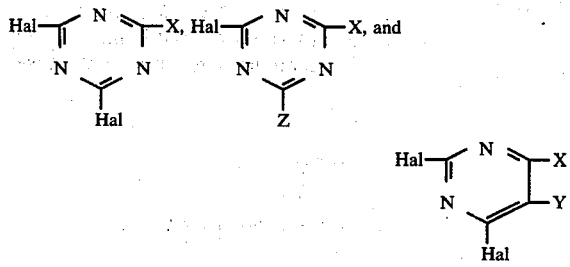

where Hal stands for F, Cl or Br, X is a group of one of the formulae

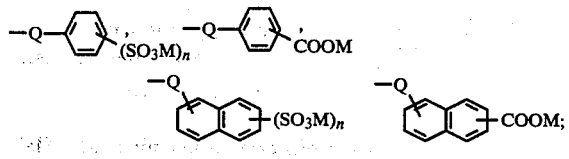

Y is H, F or Cl;

Z is an unsubstituted amino group, an amino group substituted by 1 or 2 alkyl groups with 1 to 4 carbon atoms, or an alkoxy group with 1 to 4 carbon atoms;

n is 1, 2 or 3;

Q is —O— or —NR—;

M is hydrogen or an alkali metal, e.g., sodium; and

R is hydrogen or alkyl of 1 to 4 carbon atoms;

and where the —$SO_3M$ and —COOM groups are attached to the aromatic nucleus at positions other than those ortho to the oxygen or imino bridge member and the aromatic nuclei may be further substituted by up to two halogen atoms or nitro, cyano or alkyl groups having 1 to 4 carbon atoms. Compounds of the foregoing type are the prefered reserving agents for the present invention, particularly those in which the group X contains an —$SO_3M$ group and any Hal is chlorine and most especially those compounds of the formula

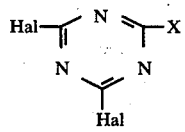

e.g., the compound

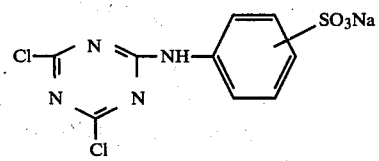

Other suitable compounds are those which contain sulfonyl groups and double bonds capable of addition or groupings capable of forming double bonds; examples are compounds of the formulae V—$SO_2$13 $CH_2$—$CH_2$—O—$SO_3M$, and

V—$SO_2$—NH—$CH_2CH_2$—O—$SO_3M$, where V is a phenyl radical which may be mono- or di-substituted by, e.g., —Cl or —$CH_3$, and compounds containing aliphatic groups and a double bond capable of addition or an exchangeable halogen atom, e.g., those of the formulae $$X-CO-CH=CH_2,\ X-CO-\underset{\underset{Hal'}{|}}{C}=CH_2,$$

$$X-CO-\underset{\underset{CH_3}{|}}{C}=CH_2,\ X-CO-CH=CH-Hal',$$

$$X-CO-\underset{\underset{Hal'}{|}}{C}=CH-CH_3,\ X-CO-CH=\underset{\underset{Hal'}{|}}{C}-CH_3,$$

$$X-CO-\underset{\underset{CH_3}{|}}{C}=CH-Hal',\ X-CO-CH=CH-CH_2-Hal',$$

$$X-CO-CH_2-Hal',\ X-CO-CH_2-CH_2-Hal',$$

$$X-CO-\underset{\underset{Hal'}{|}}{CH}-CH_2-Hal',$$

where X has one of the aforestated meanings and Hal' represents a chlorine or bromine atom.

Still other compounds useful as reserving agents are those of the formula $$A-D-(B-D)_m-A$$

wherein

A is either a group of the formula $$-NH-CO-G$$

in which G is $$-\underset{\underset{Br}{|}}{C}=CH_2 \text{ or } -\underset{\underset{Br}{|}}{CH}-\underset{\underset{Br}{|}}{CH_2}$$

or, when m is 1, B is —CH=CH— and D is

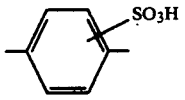

a group of the formula

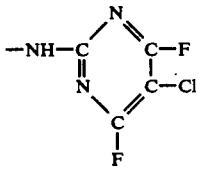

B is a direct bond, a group —CH=CH— or

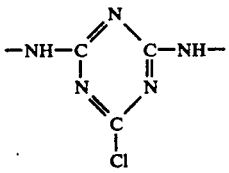

D is a phenylene or naphthylene radical containing at least one sulpho group, and m is 0, 1, 2, or 3.

The reserving agent is applied to the substrate by any method which will provide coverage of only those areas which it has been determined to reserve. This can be accomplished by padding or spraying an aqueous liquor containing the reserving agent on predetermined areas of the substrate. The preferred techniques include printing or dropping a paste of the reserving agent on the substrate using, e.g., a rotary printer or a TAK® machine, in known manner. While the reserving agent can be applied separately, it is preferably applied in admixture with an anionic and/or basic dye, most preferably the latter.

The amount of reserving agent in the paste or liquor can vary, depending on the nature of the particular substrate, the particular dyes being used in conjunction therewith, and the desired depth and/or contrast. Suitable amounts are about 0.1 to 10 percent by weight based on the weight of the substrate. The reserving agent may comprise up to about 15% by weight of the paste or liquor.

Other adjuvants conventional in the dyeing and printing arts may be included, e.g., dispersing agents, thickeners, acid binding agents, e.g., sodium or potassium carbonate or bicarbonate, and/or buffering agents, e.g. trisodium phosphate. Suitable thicheners are the alginates such as sodium alginate. Thickeners which react with the reserving agent should be avoided.

The anionic dyes which can be used with the reserving agent in accordance with the present invention are the acid (including premetallized) and direct dyes. Numerous such dyes are listed in the Colour Index under the classifications "Acid" and "Direct". Dyes which contain fiber reactive groups, such as mono- and dichlorotriazine and trichloropyrimidine groups, which would cause them to be classified as reactive dyes are not embraced by the term "anionic dye" as used herein. Suitable dyestuff classes are the azo, anthraquinone, phthalocyanine, nitro or formazane dyestuffs which can also contain metals bound in complex linkage such as copper, nickel, chromium or cobalt. Suitable azo dyestuffs are, principally, monoazo dyestuffs, e.g., of the type phenylazobenzene, phenylazonaphthalene, phenylazohydroxy- or -aminopyrazole, phenylazoacylacetylarylamide, or those of the analogous naphthylazo series, whereby the aromatic nuclei can be suitably substituted. Also suitable are dis- and polyazo dyestuffs. The azo dyestuffs, to which also belong the formazane dyestuffs, can be metallized, principally by chromium or cobalt, but also by copper or nickel, whereby one or two dyestuff molecules per metal ion participate in the complex. They can also contain the usual substituents such as halogen, nitro, acylamino, alkyl, alkoxy and sulfonyl. From the standpoint of dyeing, both those classes of anionic wool dyestuffs which are strongly acid as well as those which dye weakly acid to neutral are suitable. The preferred dyes are those containing at least one —COOH or —$SO_3H$ group, more preferably the latter.

Particularly marked reserve effects are obtained against anionic dyes bearing two or more sulfonic acid groups; in fact, full or almost full reservation of synthetic polyamide fibers can be obtained against this type of dye. A step by step decrease in the degree of reservation is obtained wth dyes bearing only one sulfonic acid group and with premetallized dyes.

As with the reserving agent, the anionic dye can be applied in the form of a liquor or a paste in amounts which will depend on the particular dye employed, the nature of the substrate (e.g., nylon 6 fixes more dye than nylon 66) and the particular effect desired. Known methods of application can be used, e.g., spraying, printing, padding and dropping. Conventional dyeing auxiliaries can also be employed where necessary, e.g., salts such as sodium or ammonium sulphate; acids such as acetic or formic acid; nonionic compounds, such as urea or thiouea; and wetting or leveling agents, such as condensation products of fatty amines with alkylene oxides or lower alkanolamines.

When used in conjunction with one another, the anionic dye and the reserving agent can be applied to the is padded over its entire surface with an anionic dye or mixture of such dyes to the desired degree of pickup, preferably at a pH of 4–7, and at a temperature which will not cause fixation, preferably room temperature; then a composition containing the reserving agent is printed, dropped or otherwise applied to the selected areas. The thus treated substrate is then subjected to a fixing step, preferably in the presence of steam, to produce the desired pattern comprising a ground color corresponding to the anionic dye with areas which, depending on the relative affinities of the dye or dyes and the reserving agent for the substrate, are either undyed or dyed in a much lighter shade of the anionic dye. The resulting multicolor pattern will depend on the number of dyes employed, their relative affinities for the substrate, the pH of the reserving agent composition and, of course, the particular pattern in which the dyes and reserving agent are applied. Thus, if the dye has a high affinity for the substrate than the reserving agents and/or the pH conditions favor rapid fixation (i.e., are on the more acid side), then less or no dye will have a chance to be displaced before fixation is accomplished; and the contrast between the reserved and unreserved areas will be only moderate. On the other hand, if the dye has a lower affinity for the substrate and/or the pH conditions favor slower fixation (i.e., a slightly acid to slightly basic), then more dye will have an opportunity to be displaced from the reserved area before fixation occurs; and the contrast between the reserved and unreserved areas will be much sharper. Moreover, when a mixture of anionic dyes having different affinities for the substrate is used, the different degrees of displacement may result in a pattern of several different colors corresponding to the individual dyes and their mixtures with one another. The anionic dye can also be applied in admixture with the reserving agent with the production of a similar resulting multicolor effect as the dye is displaced in the reserved areas upon fixing.

A particularly interesting aspect of the present invention is the discovery that basic dyes can be used in conjunction with the aforementioned reserving agent without first fixing the reserving agent. When a basic dye is used, it is advantageously applied to the substrate in admixture with the reserving agent. During the subsequent fixing step, the fiber reactive group of the reserving agent reacts with the substrate while the sulphonic acid or carboxylic acid group(s) react with the basic dye, thus bonding the dye to those areas of the substrate treated with the reserving agent. This result can also be achieved by applying the basic dye to an area that has previously been treated with the reserving agent.

The basic (or cationic) dyes constitute a well-known class, and enumeration of various typical examples would serve no purpose. Reference is made instead to the Colour Index under "Basic Dyes".

As in the case of the anionic dyes and the reserving agent, the basic dye or mixture of basic dye and reserving agent can be applied from aqueous liquors or in paste form by the usual known techniques, particularly padding, spraying and most especially by dropping or printing. Again, the usual auxiliaries can be employed. The pH of the basic dye-reserving agent combination is maintained below 10, preferably in the range 4.5 to 9, most preferably in the range 6.5 to 8, and the temperature is normally ambient.

The present invention is not limited to the application of a single basic dye or a single anionic dye. Rather, one of the principal advantages is that it makes possible the attainment of many varied effects by applying various combinations of anionic and basic dyes and reserving agents. A particularly important mode of carrying out the invention is to impregnate the entire substrate with an aqueous liquor containing one or more anionic, especially acid, dyes, which have a lower affinity for the substrate than the reserving agent, then apply one or more mixtures of basic dye and reserving agent to various different portions of the substrate and finally subject the thus treated substrate to a fixing step whereby the anionic dye is displaced from the area to which the reserving agent is applied and a substrate is produced having a background corresponding to the anionic dye with a pattern of the various basic dyes, which may be further varied if a mixture of anionic dyes having different affinities for the substrate is used. This is especially advantageous where it is desired to print a lighter design on a darker background, although the reverse effect can also be achieved by selecting the appropriate dyes.

It is also possible to achieve various shading effects by applying, in addition to the anonic and/or basic dyes, a disperse dye, which is not influenced by the reserving agent and will dye those portions of the substrate which have been treated with the reserving agent as well as those which have not. Likewise, instead of a part of the reserving agent, there may be employed a fiber reactive dye, conveniently the two being applied from a single preparation, the fiber-reactive dye compound behaving in substantially identical manner to the reserving agent, e.g., causing displacement of any anionic dye, but imparting its own color to the area to which it is applied.

The particular conditions under which fixation is effected will vary, depending on the particular combinations of dye, reserving agent and substrate employed but will be readily determinable by the skilled artisan. In general, the reserving agents become fixed in a moist atmosphere in a period of about 2 to 48 hours at room temperature and 2 hours or less at elevated temperatures. The substrate is preferably subjected to treatment in saturated steam for a period of 5 to 60 minutes at about 100° to 130° C. The skilled artisan will know or can readily determine the speed with which various dyes and reserving agents become fixed on various substrates. He can, therefore, select compounds and conditions of temperature and pH which will avoid premature fixation of any component. The dyes will normally be fixed at the same time, though it may be necessary to make small adjustments for particular dyes.

Following fixation, the multicolored substrate can be washed and dried in conventional manner.

The present invention includes but is not limited to the following types of dyeing procedures.

A. The deposition of the reserving agent onto various portions of the surface of tufted carpet which has been padded with an aionic dye, followed by steam fixing of the reserving agent and dye, whereby the anionic dye migrates from the area on which the reserving agent has been applied to form a carpet in which the areas treated with the reserving agent are either undyed or are dyed a lighter color than the unreserved areas, the essential absence or shade of color in the treated area being determined, controlled and variable depending largely on the affinity of the anionic dye for the carpet material, the pH of the composition used to apply the reserving agent and the amount of the reserving agent deposited in a given area, the lighter shades or absence of color being provided when employing anionic dyes of low affinity, reserving agent compositions having relatively high pH values and the larger amounts of reserving agents;

B. The deposition of a mixture of a basic dye and the reserving agent onto various portions of the surface of untreated tufted carpet followed by steam fixing of the dye and reserving agent to form a carpet having areas of the color of the dye in the mixture against a background of the untreated carpet material, C. The deposition of one or more mixtures of one or more basic dyes and the reserving agent onto various portions of the surface of tufted carpet which has been padded with an anionic dye followed by steam fixing of the dyes and reserving agent whereby the anionic dye migrates from the area on which the mixture containing the reserving agent has been applied to form a carpet having areas of the color(s) of the dye(s) in the mixture(s) against a ground color of the anionic dye;

D. The deposition of the reserving agent onto various portions of the surface of tufted carpet which has been padded with a mixture of two or more anionic dyes of which at least one has a clearly different affinity for carpet material, all of the anionic dyes together forming a first color but forming a second color without the dye of least affinity, followed by steam fixing of the dyes and reserving agent whereby the dye of least affinity essentially completely migrates from the area on which the reserving agent has been deposited to form a carget having areas which were treated with the reserving agent dyed with the second color against a background of the first color;

E. The random deposition onto various portions of the surface of tufted carpet of: (a) a controlled amount of the reserving agent; and (b) a mixture of a substantial amount of the reserving agent and a basic dye of a first color (e.g., blue), the carpet having been previously padded with a mixture of three anionic dyes forming a second color (e.g., yellow, blue and red forming brown but forming a third color without individual components) but forming a third color without one of the anionic dyes which is selected on the basis of clearly lower affinity for the carpet material (e.g., a low affinity red anionic dye such that the third color would be a green formed by the blue and yellow anionic dyes), followed by steam fixing of the reserving agent and dyes whereby the anionic dye of low affinity is essentially completely blocked off from the area to which just the reserving agent is applied and all anionic dyes are essentially completely displaced from the area onto which the mixture of the reserving agent and basic dye has been applied to form a carpet having a mottled pattern of the first, second, and third colors;

F. In carrying out Procedure E., above, with a carpet tufted from two, three or four polyamide yarns having different dye affinities of which one has virtually no affinity for the low affinity anionic (red) dye, there is obtainable a carpet similar to the carpet produced in Procedure E. but having increased mottling by virtue of having different shades of the third (e.g., green) color;

G. The deposition, as by spraying or immersion, on a portion, e.g., one-third of a skein of yarn of a mixture of the reserving agent and a basic dye followed by the deposition by similar means of one or more anionic dyes on the remaining portions of the skein followed by steam fixing of the reserving agent and dyes to obtain multicolored yarn which can be used, for example, in the manufacture of carpet;

H. The adapting of procedures given above, such as Procedures A, B, and C, to printing operations wherein the reserving agent or mixture of the dye and the reserving agent are printed onto the carpet in a defined pattern following by steam fixing of all dyes and the reserving agent.

I. The carrying out of Procedure C, above, with a carpet composed of variable dyeable nylon yarns of which two are acid dyeable and one is basic dyeable whereby there is obtained on steam fixing a carpet having a more or less mottled pattern in which there are two shades of the ground color (e.g., blue), areas which are white, i.e., undyed, areas having the color (e.g., yellow) of the dye in a first reserving agent mixture and areas having the color (e.g., fuchsia) of the dye in a second reserving agent mixture, together with some shading (e.g., pink) and tinting (e.g., orange and green) due to the different affinities of the acid dyeable yarns and mixing of different colors (both the ground color with a dye in a mixture and also the mixing of the dyes in the mixtures). In this procedure, the tinting can be reduced by using larger quantities of the reserving agent in the mixtures and additionally by maintaining greater spacing between the mixtures deposited on the carpet.

J. The random deposition onto various portions of tufted nylon carpet of one or more mixtures, e.g., two different mixtures, of one or more anionic dyes with the reserving agent, said carpet having been previously padded with anionic dyes constituting a first color, the dyes in the randomly deposited mixtures being faster striking than the dye(s) in the ground color and also being faster striking (greater affinity for the carpet) than the reserving agent, whereby there is obtained on steam fixing a randomly colored carpet having areas which are the color of the ground color and areas corresponding to the colors in the randomly deposited dye/reserving agent mixtures.

K. The random deposition onto various portions of the surface of tufted carpet composed of variably dyeable nylon yarns and previously padded with an anionic dye of a first color, of one or more mixtures of one or more anionic dyes in admixture with the reserving agent, the dye(s) in the mixture(s) having a greater affinity than the dye of the first color for the acid dyeable nylon yarns in the carpet, followed by steam fixing gives a carpet wherein (1) the first or ground color appears in the dyed carpet in at least two shades by reason of the variable dyeability of the nylon itself; (2) a second color is produced in the areas in which one mixture has been deposited by reason of the reserving agent displacing the ground color and the anionic dye in the mixture being very fast striking and having greater affinity for at least certain portions of the carpet than the reserving agent, the second color showing some shading due to the variable dyeability of the yarns; and (3) when employing a second mixture of a third color said third color is produced in two distinct shades in areas in which the second mixture was deposited by reason of the reserving agent displacing the ground color, and by reason of the anionic dye of the third color which is relatively fast striking having markedly greater affinity for one of the dyeable yarn components in the carpet than the reserving agent and less (or different relative) affinity than the reserving agent for another dyeable yarn component, the lighter shade of the third color resulting from substantial quantities of the reserving agent being fixed along with said dye and thereby diluting or lightening the shade of such anionic dye.

L. The carrying out of Procedure K, above, in which one of the variably dyeable nylon yarns in the carpet is a basic dyeable yarn which remains undyed and results in random white, i.e. undyed, areas in the final carpet since no basic dye is employed in the procedure.

M. The carrying out of Procedure K, above, in which one of the variably dyeable nylon yarns in the carpet is a basic dyeable yarn and in which the ground color is a mixture of one or more anionic dyes, e.g. three dyes forming a first color but a second color in the absence of one of said dyes, and one or more basic dyes forming a third color, and in which there is a random deposition on the ground color of two different reserving agent-containing mixtures having different proportions of the same two anionic dyes, whereby on steam fixing the basic dyes are fixed to the basic dyeable portion to form a third color, only two of the three anionic dyes in the ground color the ground color mixture is of low affinity thereby forming two different shades of the second color one of the mixtures randomly distributed resulting essentially in a fourth color, which is the color of the mixture because the reserving agent displaces the ground colors and the dyes in the mixture have sufficient total affinity relative to the reserving agent that the color of the mixture is obtained, and the second randomly deposited mixture, containing a lesser amount of the slower striking dye in the mixture than in the other randomly deposited mixture, resulting essentially in a fifth color which is essentially the color of only one of the wo anionic dyes in the mixture by reason of the reserving agent displacing all or enough of the other color so that such other dye is not fixed in a quantity sufficient substantially to create the color of the mixture.

N. The carrying out of Procedure M, above, but without the mixture of basic (cationic) dyes in the ground color whereby similar results are obtained but with the addition of random areas which are white, i.e. undyed, by reason of there being no dye to dye the basic dyeable nylon in the carpet.

In procedures such as Procedures J, K and L wherein there are no basic (cationic) dyes present, it is to be noted that similar procedures and results have been effected in the past without the use of a reserving agent. However, the use of the reserving agent in accordance with this invention has been found to effect a substantial improvement, particularly with regard to the clarity, depth, sharpness and/or shade of the color in the dye/-reserving agent mixture, mainly by reason of the ability of the reserving agent to facilitate the removal or displacement of the lower affinity anionic dye of the ground color.

When employing totally acid dye systems or when applying acid dyes with reserving agent to areas already treated with acid dyes to effect displacement of the latter, it is preferred to employ anionic dye/reserving agent mixtures which have a pH higher than the pH best suited for fixing of the anionic dye, since the generally preferred reserving agents are more reactive at the higher pH levels. However, in such cases the reserving agents which react with material to liberate a strong inorganic acid or equivalent, e.g. hydrogen chloride, are particularly preferred as the liberated acid then effects a reduction of the pH of the balance of the mixture to a level more conducive to the fixing of the faster striking anionic dye.

The invention is illustrated by the following Examples in which parts and percentages are by weight and temperatures are in degrees centigrade, unless otherwise stated.

EXAMPLE 1

Nylon carpet is introduced into an aqueous dyebath having a temperature of about 22° and a pH of about 5.2 and containing:

0.3% dyestuff C.I. Acid Blue 72,
0.2% Sandogen ® C-PK leveling agent,
0.3% natural gum thickener Syngum D47D (Stein, Hall Co.),
0.1% monosodium phosphate, and
0.05% trisodium phosphate;

Excess liquor is expressed to give a pickup of 100%. The thus treated material is then passed at a rate of 10 yds/min through a TAK ® machine, the operation of which is described in *American Dyestuff Reporter,* Volume 60, No. 6, June, 1971, wherein there is dropped on selected areas of the carpet at room temperature an aqueous paste having a pH of 7 and containing 6% of a compound of the formula A:

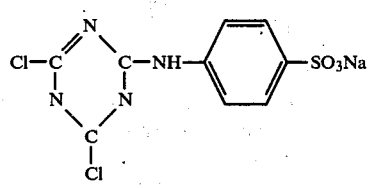

A 0.3% dyestuff C.I. Basic Orange 38,
0.2% Sandogen C-CM,
0.7% Syngum D47D thickener, and
0.1% trisodium phosphate.

It is then passed through a second TAK ® machine where there is deposited on other areas of the carpet a paste having the same composition as the previous paste except for the replacement of the orange dye with the dye C.I. 48055 Basic Yellow 11.

The thus treated carpet is then steamed for 10 minutes at 100° to effect fixation of the dyes and the reserving agent and produce a pattern of orange, yellow and green on a blue background.

EXAMPLE 2

Nylon carpet of light and deep dyeable yarns (50:50) is introduced into an aqueous dyebath maintained at room temperature and at a pH of 6.5 and containing:

0.62% of the acid dye Nylosan ® Yellow E-RM (Sandoz),
0.25% C.I.62125 Acid Blue 40, 0.08% C.I. 23905 Acid Red 145,
0.3% Syngum D47D thickener,
b 0.8% Sandogen C-PK leveling agent,
0.1% monosodium phosphate, and
0.04% trisodium phosphate.
Pickup was 80%.

The thus treated fabric is then passed through a first TAK machine wherein there is applied an aqueous paste having a pH of 7.5 and containing:
1.0% of the compound of formula A,
0.6% Syngum D47D,
0.2% Sandogen C-PK,
0.1% monosodium phosphate,
0.12% trisodium phosphate.

It is then passed through a second TAK machine for application of an aqueous paste having a pH of 7.5 and containing:
6.0% of the compound of formula A,
0.4% Sandocryl ® Blue B-GRL Basic Blue Dye (Sandoz),
0.12% trisodium phosphate,
0.6% Syngum D47D,
0.2% Sandogen C-PK,
0.2% Sandogen C-CM, and
0.1% monosodium phosphate.
Passage through the TAK machines was at a speed of 10 yds/minute.

The thus treated material is then steamed for about 9 minutes and washed to produce a mottled pattern of brown, blue and two distinct shades of green.

EXAMPLE 3

Nylon 6 carpet is introduced into an aqueous dyebath, maintained at room temperature and at a pH of 6.5 and containing:
0.4% C.I.62125 Acid Blue 40,
0.3% Syngum D47D thickener,
0.8% Sandogen C-PK leveling agent,
0.1% monosodium phosphate, and
0.04% trisodium phosphate.
Pickup was 80%.

The thus treated fabric is then passed through a TAK machine wherein there is applied an aqueous paste having a pH of 7.5 and containing:
6.0% of the compound of formula A,
0.4% C.I.48955 Basic Yellow 11,
0.12% trisodium phosphate,
0.6% Syngum D47D,
0.2% ethoxylated alcohols, and
0.1% monosodium phosphate.
Passage through the TAK machines was at a speed of 10 yds/minute.

The thus treated material is then steamed for about 9 minutes and washed to produce a pattern of yellow on a blue background.

EXAMPLE 4

Nylon shag carpet containing light and deep acid dyeable yarn and basic dyeable yarn is introduced into an aqueous dyebath maintained at room temperature and a pH of 4, said dyebath containing:

| | | |
|---|---|---|
| 0.30% | of the acid dye Nylosan ® Blue M-R, | |
| 0.25% | Syngum D47D thickener, | |
| 0.60% | Sandogen ® C-PK wetting agent, and | |
| | monosodium phosphate | } to pH 4. |

-continued

| |
|---|
| Acetic acid |

Excess liquor is expressed to give a pickup of 100%. The thus treated carpet is then passed at a rate of 10 yds/min. through a first TAK machine wherein there is applied an aqueous paste having a pH of 9.5 and containing:
1.0% of the acid dye Nylon Printing Yellow GLS,
1.0% of the compound of formula A,
0.5% trisodium phosphate.
It is then passed through a second TAK machine at the same rate for application of an aqueous paste having a pH of 9.5 and containing:
0.65% of the acid dye Nylosan Brilliant Green F-6GL,
1.00% of the compound of formula A,
0.60% Syngum D47D, and
0.50% trisodium phosphate.

The resultant carpet is then steamed for 10 minutes and washed to produce a mottled pattern of yellow, white, two distinct shades of blue and two distinct shades of green.

EXAMPLE 5

Nylon shag carpeting containing light and deep acid dyeable yarn and basic dyeable yarn is introduced into an aqueous dyebath maintained at room temperature and adjusted to a pH of with acetic acid and monosodium phosphate, said dyebath containing:
0.550% of the acid dye Nylosan ® Yellow M-2G,
0.003% of the acid dye Nylosan Red M-2GL,
0.100% of the acid dye Nylosan Blue M-HRL,
0.075% of the basic dye Sandocryl ® Brilliant Yellow B-6GL,
0.025% of the basic dye Sandocryl Blue B-GRL,
0.250% Syngum D47D,
1.200% Sandogen ® C-PK, and
0.200% Lyogen ® SMK-40 anti-precipitant.
Excess liquor is expressed to give a pickup of 100%. The thus treated carpet is then passed at a rate of 10 yds/min. through a first TAK machine wherein there is applied an aqueous paste having a pH of 9.5 and containing:
0.25% of the acid dye Nylon Printing Red BW,
0.25% of the acid dye Nylon Printing Yellow GLS,
2.00% of the compound of formula A,
0.60% Syngum D47D, and
0.50% trisodium phosphate.
It is then passed through a second TAK machine at the same rate for application of an aqueous paste having a pH of 9.5 and containing:
0.500% of the acid dye Nylon Printing Yellow GLS,
0.025% of the acid dye Nylon Printing Red BW,
2.000% of the compound of formula A,
0.600% Syngum D47D, and
0.500% trisodium phosphate.
The resultant carpet is then steamed for 10 minutes and washed to produce a mottled pattern of red, orange, and two distinct shades of green.

EXAMPLE 6

Nylon shag carpeting containing light and deep acid dyeable yarn and basic dyeable yarn is introduced into an aqueous dyebath maintained at room temperature and a pH of 4, said dyebath containing:
0.550% of the acid dye Nylosan ® Yellow M-2G,
0.003% of the acid dye Nylosan Red M-2GL, 0.100% of the acid dye Nylosan Blue M-HRL,
0.250% Syngum D47D,
1.200% Sandogen ® C-PK, and
0.200% Lyogen ® SMK-40.

Excess liquor is expressed to give a pickup of 100%. The thus treated carpet is then passed at a rate of 10 yds/min. through a first TAK machine wherein there is applied an aqueous paste having a pH of 9.5 and containing:

0.25% of the acid dye Nylon Printing Red BW,
0.25% of the acid dye Nylon Printing Yellow GLS,
2.00% of the compound of formula A,
0.60% Syngum D47D, and
0.50% trisodium phosphate.

It is then passed through a second TAK machine at the same rate for application of an aqueous paste having a pH of 9.5 and containing:

0.500% of the acid dye Nylon Printing Yellow GLS,
0.025% of the acid dye Nylon Printing Red BW,
2.000% of the compound of formula A,
0.600% Syngum D47D, and
0.500% trisodium phosphate.

The resultant carpet is then steamed for 10 minutes and washed to produce a mottled pattern of red, orange, white and two distinct shades of green.

EXAMPLE 7

Nylon shag carpeting containing regular acid dyeable yarn is introduced into an aqueous dyebath maintained at room temperature and a pH of 4, said dyebath containing:

0.50% of the acid dye Nylosan ® Blue M-HRL,
0.25% Syngum D47D, and
1.20% Sandogen ® C-PK.

Excess liquor is expressed to give a pickup of 100%. The thus treated carpet is then passed at a rate of 10 yds/min. through a first TAK machine wherein there is applied an aqueous paste having a pH of 7.5 and containing.

0.40% of the basic dye Sandocryl ® Yellow B-GL,
2.00% of the compound of formula A,
0.60% Syngum D47D,
0.20% Lyogen ® SMK-40,
0.12% trisodium phosphate, and
0.06% monosodium phosphate.

It is then passed through a second TAK machine at the same rate for application of an aqueous paste having a pH of 7.5 and containing:

0.40% of the basic dye Sandocryl Brillant Red B-3B,
2.00% of the compound of formula A,
0.60% Syngum D47D,
0.20% Lyogen ® SMK-40,
0.12% trisodium phosphate, and
0.06% monosodium phosphate.

The resultant carpet is then steamed for 10 minutes and washed to produce a pattern of fuchsia and yellow on a blue background.

EXAMPLE 8

Proceeding in a manner analogous to Example 7, and employing nylon shag carpeting containing light and deep acid dyeable yarn and basic dyeable yarn, there is produced a carpet exhibiting a mottled pattern of fuchsia, yellow, white and two distinct shades of blue, with some limited areas showing tints of orange, green, and other shades of pink or red.

EXAMPLE 9

Nylon shag carpeting containing light and deep acid dyeable yarn and basic dyeable yarn is introduced into an aqueous dyebath maintained at room temperature and a pH of 4, said dyebath containing:

0.70% of the acid dye Nylosan ® Yellow M-2G,
0.10% of the acid dye Nylosan Red M-2GL,
0.20% of the acid dye Nylosan Blue M-HRL,
0.25% Syngum D47D, and
1.20% Sandogen ® C-PK.

Excess liquor is expressed to give a pickup of 100%. The thus treated carpet is then passed at a rate of 10 yds/min. through a first TAK machine wherein there is applied an aqueous paste having a pH of 7.5 and containing:

0.40% of the basic dye Sandocryl ® Yellow B-GL,
6.00% of the compound of formula A,
0.60% Syngum D47D,
0.20% Lyogen ® SMK-40,
0.12% trisodium phosphate, and
0.06% monosodium phosphate.

It is then passed through a second TAK machine at the same rate for application of an aqueous paste having a pH of 7.5 and containing:

0.30% of the basic dye Sandocryl Blue B-RLE,
6.00% of the compound of formula A,
0.60% Syngum D47D,
0.20% Lyogen ® SMK-40
0.12% trisodium phosphate, and
0.06% monosodium phosphate.

The resulting carpet is then steamed for 10 minutes and washed to produce a mottled pattern of yellow, white, two distinct shades of blue and two distinct shades of brown with some limited areas showing a tint of green.

In the foregoing examples, Nylosan, Sandogen, Lyogen and Sandocryl are registered trademarks of Sandoz, Inc., Hanover, New Jersey.

The terms "displacing" and the like as used herein largely replace the terms "migration" and the like used in my above-referred to prior application. Both terms are intended to have the same basic meaning and to indicate the inability of the substance, in whole or in part, to be available for fixing in the area to which it is applied by reason of the presence or introduction in the area of another substance having greater affinity for fixing in the area. The displaced substance is essentially completely removed from the substrate in subsequent treatments such as in the steam fixing step itself or in later washings or similar treatments. Any tendency in certain situations for displaced dyes to be fixed in areas bordering those from which they have been displaced is usually controlled, or when occurring, can be turned to advantage by proper selections of colors to obtain other effects.

While certain mechanisms by which the present invention and its various aspects work are expressly or implicitly set forth herein, it is not intended that such disclosure shall constitute a complete explanation of such mechanisms or a complete indication of all mechanisms by which the invention or any of the various embodiments thereof operate.

What is claimed is:

1. In a process which comprises applying to a substrate dyeable with an anionic dye (1) a reserving agent which is a colorless organic compound containing a group which is reactive with the available basic groups of the substrate and further containing a sulfonic acid or carboxylic acid group and (2) one or more dyes selected from the group consisting of acid, direct and basic dyes and mixtures thereof and fixing the applied compounds on the material comprising said substrate, the reserving agent being applied to less than the whole of the substrate, and at least one dye and reserving agent being applied to at least one common area of the substrate, the improvement wherein the reserving agent and the dye or dyes are simultaneously fixed.

2. A process according to claim 1 wherein the dye is a basic dye.

3. A process according to claim 1 wherein the dye is an acid or direct eye.

4. A process according to claim 2 wherein the reserving agent and a basic dye are applied in admixture with one another.

5. A process according to claim 3 wherein the dye is an acid dye.

6. A process according to claim 1 wherein the whole area of the substrate is impregnated with an aqueous solution containing at least one acid dye, and the reserving agent is applied to one or more portions but less than the whole area of the impregnated substrate.

7. A process according to claim 6 wherein one or more basic dues are applied to the portion or portions of the substrate treated with the reserving agent.

8. A process according to claim 7 wherein the basic dye or dyes are applied in admixture with further reserving agent.

9. A process according to claim 8 wherein fixation is effected at elevated temperature.

10. A process according to claim 9 wherein fixation is effected with steam.

11. A process according to claim 1 wherein the reserving agent is a compound of one of the formulae:

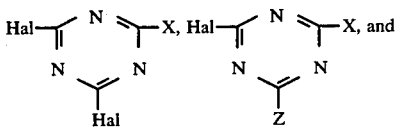

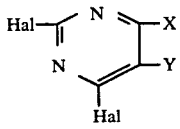

where

Hal stands for fluoro, chloro, or bromo,

X is a group of one of the formulae:

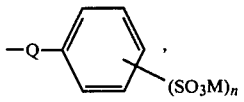

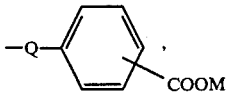

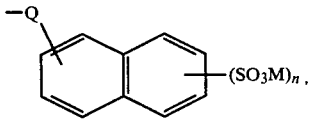

-continued and

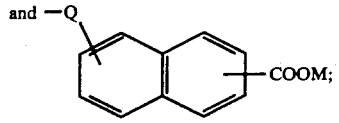

in which

Y is hydrogen, fluoro, or chloro;

Z is a unsubstituted amino group, an amino group substituted by 1 or 2 alkyl groups with 1 to 4 carbon atoms, or an alkoxy group with 1 to 4 carbon atoms;

n is 1, 2 or 3;

Q is —O— or —NR—;

M is hydrogen or an alkali metal; and

R is hydrogen or alkyl of 1 to 4 carbon atoms;

and where the $—SO_3M$ and —COOM groups are attached to the aromatic nucleus at positions other than those ortho to the oxygen or imino bridge member and the aromatic nuclei may be substituted by halo, nitro, cyano, or alkyl or 1 to 4 carbon atoms;

or of the formulae:

$$V—SO_2—CH_2—CH_2—O—SO_3M, \text{ and}$$

$$V—SO_2—NH—CH_2—CH_2—O—SO_3M,$$

where V represents a phenyl radical which may be substituted by chloro or methyl and M is as defined above;

or of one of the formulae:

$$X—CO—CH{=}CH_2,\ X—CO—\underset{\underset{Hal'}{|}}{C}{=}CH_2,$$

$$X—CO—\underset{\underset{CH_3}{|}}{C}{=}CH_2,\ X—CO—CH{=}CH—Hal',$$

$$X—CO—\underset{\underset{Hal'}{|}}{C}{=}CH—CH_3,\ X—CO—CH{=}\underset{\underset{Hal}{|}}{C}—CH_3,$$

$$X—CO—\underset{\underset{CH_3}{|}}{C}{=}CH—Hal',\ X—CO—CH{=}CH—CH_2—Hal', \text{ and}$$

$$X—CO—\underset{\underset{Hal'}{|}}{CH}—CH_2—Hal',$$

wherein x is as defined above Hal' is chloro or bromo;

or of the formula:

$$A—D—(B—D)_m—A$$

wherein

A is either a group of the formula $$—NH—CO—G$$

in which G is $—\underset{\underset{Br}{|}}{C}{=}CH_2$ or $—\underset{\underset{Br}{|}}{CH}—\underset{\underset{Br}{|}}{CH_2}$ or, when m is 1, B is —CH=CH— and D is

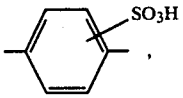

a group of the formula

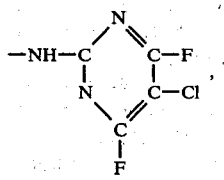

B is a direct bond, a group —CH=CH— or

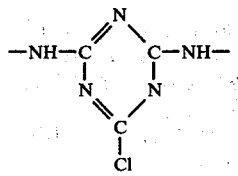

D is a phenylene or naphthylene radical containing at least one sulpho group, and m is 0, 1, 2, or 3.

12. A process according to claim 11 wherein the reserving agent is a compound of one of the formulae:

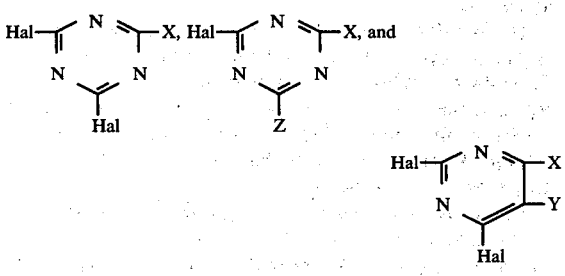

13. A process according to claim 12 wherein the reserving agent is of the formula:

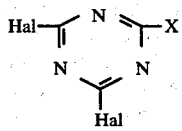

14. A process according to claim 13 wherein the reserving agent is of the formula

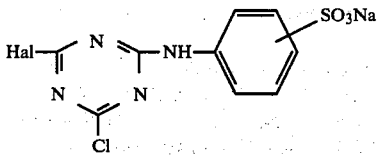

15. A process according to claim 5 wherein the whole area of the substrate is impregnated with an aqueous solution containing at least one acid dye, and two or more mixtures, each of which comprises one or more basic dyes in admixture with the reserving agent, are successivey applied to one or more portions but less than the whole area of the impregnated substrate.

16. A process according to claim 8 wherein the acid dye is applied in admixture with at least one further acid dye, at least one dye in said mixture having a different affinity for the substrate than another dye in said mixture.

17. A process according to claim 16 wherein the substrate comprises two anionic dyeable materials of different anionic dye affinities.

18. A process according to claim 5 wherein the whole area of the substrate is impregnated with an aqueous solution containing at least one acid dye, and one or more basic dyes in admixture with the reserving agent is applied to one or more portions but less than the whole area of the impregnated substrate.

19. A process according to claim 18 wherein fixation is effected at elevated temperature.

20. A process according to claim 19 wherein fixation is effected with steam.

21. A process according to claim 20 wherein the amount of reserving agent is such that there is obtained on fixation portions having the color of the basic dye or dyes by reason of the reserving displacing the acid dye or dyes.

22. A process according to claim 5 wherein the whole area of the substrate is impregnated with an aqueous solution containing at least one acid dye, and one or more mixtures each of which comprises one or more acid dyes in admixture with the reserving agent, is applied to one or more portions but less than the whole area of the impregnated substrate.

23. A process according to claim 22 wherein the substrate comprises two anionic dyeable materials of different anionic dye affinities and one basic dyeable material.

24. A process according to claim 1 wherein the whole area of the substrate is impregnated with an aqueous solution containing a mixture of at least one acid dye and at least one basic dye, and one or more mixtures each of which comprises one or more acid dyes in admixture with the reserving agent, is applied to one or more portions but less than the whole area of the impregnated substrate.

25. A process according to claim 24 wherein the substrate comprises two anionic dyeable materials of different anionic dye affinities and one basic dyeable material.

26. A process according to claim 15 wherein the substrate comprises two anionic dyeable materials of different anionic dye affinities and one basic dyeable material.

27. A process according to claim 6 wherein the acid dye is applied in admixture with at least one further acid dye, at least one dye in said mixture having a different affinity for the substrate than the other dye or dyes in said mixture.

28. A process according to claim 27 wherein the mixture of acid dyes forms a first color but forms a second color in the absence of the acid dye in said mixture having less affinity for the substrate whereby there is obtained on fixation portions having the second color by reason of the reserving agent displacing said dye of less affinity.

29. A process according to claim 16 wherein the mixture of acid dyes forms a first color but forms a second color in the absence of the acid dye in said mixture having less affinity for the substrate whereby there is obtained on fixation portions having the second color by reason of the reserving agent displacing said dye of less affinity and portions having the color of the basic dye or dyes by reason of the further reserving agent displacing the acid dye or dyes.

30. A process according to claim 16 wherein the substrate comprises at least two anionic dyeable materials of different anionic dye affinities and one basic dyeable material.

31. A process according to claim 4 wherein one portion of the substrate is impregnated with an aqueous solution containing at least one basic dye and the reserving agent, and at least one acid dye is applied to one or more of the remaining portions of the substrate.

32. A process according to claim 18 wherein the substrate comprises two anionic dyeable materials of different anionic dye affinities and one basic dyeable material.

33. A process according to claim 22 wherein fixation is effected at elevated temperature.

34. A process according to claim 33 wherein fixation is effected with steam.

35. A process according to claim 34 wherein the mixture of acid dyes with which the whole area of the substrate is impregnated forms a first color and the acid dye or dyes which are applied in admixture with the reserving agent forms one or more other colors, whereby there is obtained on fixation portions having one or more other colors by reason that the mixture of acid dyes with which the whole area of the substrate is impregnated has less affinity for the substrate than the reserving agent or the acid dye or dyes which are applied in admixture with the reserving agent.

36. A process according to claim 35 wherein the substrate comprises dyeable materials of different anionic dye affinities.

37. A process according to claim 36 wherein the substrate comprises at least two anionic dyeable materials of different anionic dye affinities and one basic dyeable material.

38. A process according to claim 25 wherein the whole area of the substrate is impregnated with an aqueous solution containing a mixture of acid dyes and one or more basic dyes.

39. A process according to claim 38 wherein the mixture of acid dyes forms a first color but forms a second color in the absence of the acid dye in said mixture having less affinity for the substance whereby there is obtained on fixation portions having the second color in two different shades by reason of the reserving agent displacing said dye of less affinity, portions having the color of the basic dye or dyes and portions having one or more other colors by reason that the mixture of acid dyes with which the whole area of the substrate is impregnated has less affinity for the substrate than the reserving agent or the acid dye or dyes which are applied in admixture with the reserving agent and contains a greater amount of the acid dye having less affinity for the substrate.

40. A process according to claim 23 wherein the whole area of the substrate is impregnated with an aqueous solution containing a mixture of acid dyes.

41. A process according to claim 40 wherein the mixture of acid dyes forms a first color but forms a second color in the absence of the acid dye in said mixture having less affinity for the substrate whereby there is obtained on fixation portions having the second color in two different shades by reason of the reserving agent displacing said dye of less affinity, portions which are undyed by reason that no basic dye is employed and portions having one or more other colors by reason that the mixture of acid dyes with which the whole area of the substrate is impregnated has less affinity for the substrate than the reserving agent or the acid dye or dyes which are applied in admixture with the reserving agent and contains a greater amount of the acid dye having less affinity for the substrate.

42. A process according to claim 1 wherein the reserving agent is applied to less than the whole area of the substrate.

43. A process according to claim 5 wherein the substrate is impregnated with an aqueous solution of an acid dye, and the reserving agent is applied to a portion of the impregnated material.

44. A process according to claim 43 wherein the material is polyamide.

45. A process according to claim 44 wherein the material is synthetic polyamide.

46. A process according to claim 18 wherein the material comprising the substrate is synthetic polyamide.

47. A process according to claim 11 wherein the reserving agent is one which is not appreciably volatile at 100° C.

48. A process according to claim 42 wherein the reserving agent is deposited on to various portions of the substrate which has been padded with an anionic dye and the reserving agent and dye are fixed by steam, whereby the anionic dye migrates from the areas on which the reserving agent has been applied, said substrate being tufted carpet.

49. A process of creating multicolored effects in materials which are dyeable with anionic dyes which comprises treating the material with an anionic dye, treating a portion of a material which is treated with the dye with a reserving agent before said dye has been fixed, said reserving agent portion of material to which both have been applied and changing the anionic dye receptivity of said common portion, exposing the thus treated material to a dye fixing treatment which fixes the anionic dye on those portions of the material from which it has not been displaced without fixing at least some of said dye in the portion from which it has been displaced and washing the thus treated material.

50. A process according to claim 40 wherein the dye and material are still wet when the reserving agent is applied.

51. A process according to claim 50 wherein the material is still wet when it is exposed to the dye fixing treatment.

52. A process according to claim 49 wherein the dye fixing treatment is a steaming operation.

53. A process according to claim 50 wherein the dye fixing treatment is a steaming operation.

54. A process according to claim 51 wherein the dye fixing treatment is a steaming operation.

* * * * *

UNITED STATES PATENT AND TRADEMARK OFFICE

CERTIFICATE OF CORRECTION

PATENT NO. : 4,218,217

DATED : August 19, 1980

INVENTOR(S) : Lewis M. Redd, Jr.

It is certified that error appears in the above—identified patent and that said Letters Patent is hereby corrected as shown below:

Col. 15, Claim 3, line 14; delete the word "eye" and insert in its place the word --dye--.

Col. 15, Claim 7, line 27; delete the word "dues" and insert in its place the word --dyes--.

Col. 16, Claim 11, the third line beneath the formula; delete the word "a" and insert in its place the word --an--.

Col. 16, Claim 11, line 22; delete the word "or" (second occurrence) and insert in its place the word --of--.

Col. 17, Claim 11; delete the first structural formula and insert in its place the formula -- 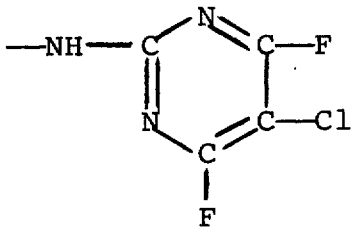 , -- .

UNITED STATES PATENT AND TRADEMARK OFFICE

CERTIFICATE OF CORRECTION

PATENT NO. : 4,218,217

DATED : August 19, 1980

INVENTOR(S) : Lewis M. Redd, Jr.

It is certified that error appears in the above—identified patent and that said Letters Patent is hereby corrected as shown below:

Col. 17, Claim 15, line 64; delete the word "successivey" and insert in its place the word --successively--.

Col. 18, Claim 21, line 19; after the word "reserving" insert the word --agent--.

Signed and Sealed this

*Twenty-ninth* Day of *June 1982*

[SEAL]

*Attest:*

GERALD J. MOSSINGHOFF

*Attesting Officer*

*Commissioner of Patents and Trademarks*